United States Patent [19]

Klyne

[11] Patent Number: 4,621,690

[45] Date of Patent: Nov. 11, 1986

[54] SUCKER ROD COUPLING

[75] Inventor: Albert A. Klyne, Edmonton, Canada

[73] Assignee: Diversified Drilling Services Ltd., Leduc, Canada

[21] Appl. No.: 722,848

[22] Filed: Apr. 12, 1985

[51] Int. Cl.[4] ..... E21B 17/10

[52] U.S. Cl. ..... 166/241; 166/176

[58] Field of Search ..... 166/241, 176; 175/325; 308/4 A, 6 A; 15/104.16

[56] References Cited

U.S. PATENT DOCUMENTS

| | | | |
|---|---|---|---|
| 713,723 | 11/1902 | Vinzent | 308/6 A |
| 1,281,756 | 10/1918 | Black | 308/4 A |
| 1,507,972 | 9/1924 | Loop | 308/4 A |
| 2,198,720 | 4/1930 | Edgecomb et al. | 308/6 A |

*Primary Examiner*—James A. Leppink
*Assistant Examiner*—Matthew Smith
*Attorney, Agent, or Firm*—Ernest Peter Johnson

[57] ABSTRACT

An improved sucker rod coupling is provided for use in a rod string in a pumping oil well. An elongate, cylindrical body member is utilized. This member has internally threaded, longitudinal bores at each end thereof, for connection with the sucker rods which it is to join. Transversely extending, substantialy diametric, longitudinally spaced apart, vertical slots are formed in the mid-portion of the body member. A wheel is mounted on a horizontally extending pin within each slot, for rotation therein. A portion of the wheel protrudes beyond each side of the body member, to thereby provide an anti-friction roller for the coupling when it contacts and slides against the surrounding tubing wall during reciprocation of the rod string. Preferably, the wheel is spaced from the side walls of the slot, so as to be movable laterally within the slot. This arrangement permits the wheel to shift back and forth on its pin, to thereby expel sand and wax building up between the wheel and the slot walls. Additionally, the wheel is preferably manufactured of a lubricious material, such as nylon, so as not to score the tubing, and is formed with a lenticular configuration. This configuration appears to have the benefit of assisting in expelling sand and wax from the wheel slot. The coupling is effective to provide a long-lasting, anti-friction, centralizing means, which means are self-cleaning and thus do not readily seize up by clogging with sand and wax in the oil.

4 Claims, 2 Drawing Figures

SUCKER ROD COUPLING

BACKGROUND OF THE INVENTION

Oil is commqnly produced from a subterranean formation through a string of tubing extending to the surface. The oil is commqnly lifted through the tubing by the action of a downhole pump actuated by a sucker rod string which is reciprocated at surface by a pump jack.

A sucker rod string is made up of a multiplicity of individual sucker rods threaded together end to end to form the string. Each sucker rod comprises a main stem, typically having a length of about 30 feet and a diameter of $\frac{3}{4}$ inches. At one end, the sucker rod has an enlarged coupling member having an externally threaded pin; at its outer end, it has a second enlarged coupling member having an internally threaded box. These coupling members typically have a diameter of $1\frac{7}{8}$ inches The tubing in which the rod string moves typically has an inside diameter of $2\frac{1}{2}$ inches.

The use of sucker rod strings in directional or slanted wellbores has been attended with problems. The steel rod string tends to lie along the low side of the tubing string and, with time, reciprocation of the rod string tends to wear away the wall of the tubing string.

This problem has been comprehended and grappled with in the prior art. One concept which has been explored involved incorporating centralizing anti-friction means into the rod string, to space the rods from the tubing and reduce wear of the tubing wall. Patents which exemplify the prior art solutions based on this concept are: U.S. Pat. No. 2,198,720 (Edgecomb et al); U.S. Pat. No. 1,508,845 (Giles); U.S. Pat. No. 2,783,028 (Jamison); U.S. Pat. No. 2,601,478 (Weir); U.S. Pat. No. 1,541,791 (Christofferson); and U.S. Pat. No. 1,507,972 (Loop).

The present invention grew out of a series of different embodiments which were built and tried.

The first embodiment involved cutting a circumferential slot in the surface of each rod string coupling. This slot was filled with a wrapping of rawhide. The rawhide had two desirable qualities: it was slippery and, if it separated from the coupling and dropped down the tubing, it did not cause damage (as would be the case with steel 'junk'). However the rawhide would swell and restrict clearance needed for the movement of oil between the rod and tubing strings.

The next version tried involved using a split ring plastic sleeve in place of the rawhide. But these sleeves came off easily and dropped down the annulus between the strings and interfered with the proper operation of the rod string and downhole pump.

Consideration was then given to mounting small, protruding wheels in the coupling body. The concept considered was to cut slots partway into the body, in the manner shown by Edgecomb, and mount the wheels on pin axles. However this approach was discarded for the following reasons:

the wheels and axles would be small in dimension, due to space limitations, and thus would be liable to fail and drop out of the slot;

and, because these components would be made of steel, such failure would result in steel junk dropping to the base of the tubing string onto the pump, which is undesirable.

Another problem, which was making itself apparent during this design and testing stage, had to do with the nature of the produced oil stream being dealt with. The couplings were being used in slanted, shallow wells producing heavy oil containing much sand. Parrafin wax is commonly associated with such heavy oil. The combination of wax and sand would readily clog up moving parts.

SUMMARY OF THE INVENTION

At this point in the evolution of the invention, it was decided to form substantially diametrical slots which extended right through the coupling body. This meant that larger wheels and pins could be used within the constraints of the space limitations involved. These larger wheels and pins would be less likely to fail. In addition, the wheels would project out each side of the coupling and contact the tubing wall. If a pin failed, the wheel and pin would tend to remain in place within the slot, because the wheel would be held there by the bracketing surfaces of the tubing wall. In addition, it was hoped that the slot, which was open on both sides, would permit ejection of collecting wax and sand, thereby reducing likelihood of the wheel seizing up due to the slot becoming clogged with the wax and sand.

When this version of the device was tested, it was found that mechanical failure of the wheel and pin was not a significant problem. However, seizing up of the wheel with wax and sand was not eliminated—it typically occurred within a month in the wells in which the device was tested.

This initial "diametrical" version had wheels which had close clearances (about 0.01") from the adjacent slot walls.

A coupling was then made and tried having diametrical slots, but the wheels had a "sloppy fit"—that is, there was provided a clearance of about 0.1" between each side of the wheel and the adjacent surface of the slot side wall, when the wheel was centrally positioned on the pin.

When tested, it was found that this "sloppy fit" version gave much improved performance, with respect to seizure of the wheels. Tests showed that the wheels were still rotating freely several months after insertion in wells in which the initial diametrical couplings had been seized up in about a month.

It is believed that the use of an open-ended slot and provision of the transverse movement capability of the wheel along the pin axis combine to provide an assembly which in use is characterized by the slot being cleared of the wax and sand that would otherwise clog it and seize up the wheel.

In accordance with the invention, therefore, there is provided an improved anti-friction sucker rod coupling for connecting a pair of sucker rods and centralizing them in a tubing string. The coupling comprises: an elongate, rigid, substantially cylindrical body member, each end of said body member forming means for threadably connecting said body member with a sucker rod, said body member further forming a transversely extending, substantially diametric, generally vertical slot extending therethrough, said body member further forming a pin bore, such pin bore extending transversely through the body member so as to intersect the slot substantially perpendicularly; a wheel member positioned within the slot to rotate in a generally vertical plane, said wheel member having a portion thereof extending beyond the periphery of said body member to engage the inner surface of the tubing string and centralize the coupling; and a pin mounted in said pin bore and supporting the wheel member thereon, whereby the wheel member is rotatable within said slot; said wheel member having sufficient clearance between its side surfaces and the wall surfaces of the slot, when the wheel member is centered in the slot on the pin, whereby the wheel member may shift along the pin to assist in ejecting sand and oil from the slot.

DESCRIPTION OF THE PREFERRED EMBODIMENT

Figure 1:
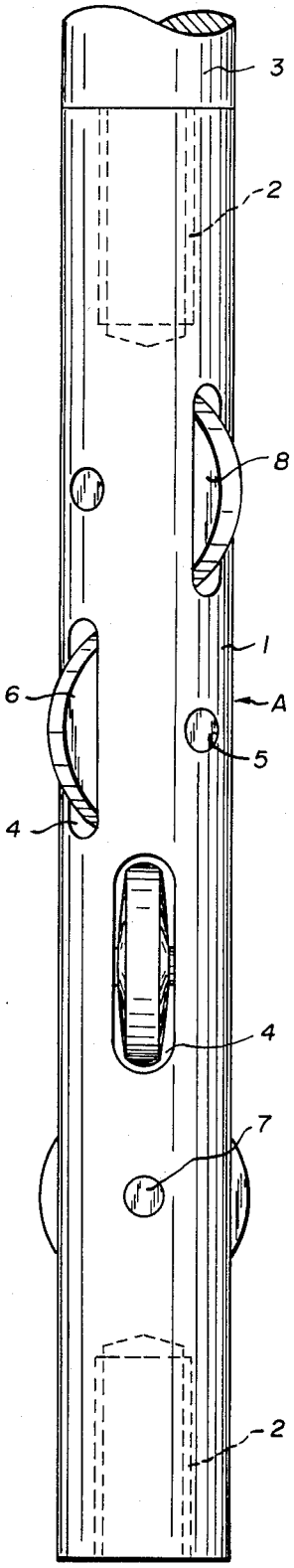
FIG. 1 is a side view of the coupling.

The anti-frictional, centralizing sucker rod coupling A comprises a body member 1. This body member 1 is solid, rigid, elongate and cylindrical. An internally threaded bore 2 extends longitudinally into each of its ends, for connection with the threaded pin ends of the sucker rods 3 which it joins together.

A plurality of diametric and vertically directed slots 4 extend transversely through the body member 1. As shown, the slots 4 are spaced one above another around the circumference of the body member.

A plurality of horizontally directed pin bores 5 extend through the body member 1. Each such pin bore 5 intersects one of the slots 4 perpendicularly.

A plurality of wheel members 6 are mounted on pins 7 in the slots 4 and pin bores 5. More particularly, a wheel member 6, having a diameter selected to just fit into the tubing which is to receive the rod string, is positioned longitudinally in each slot 4. A pin 7 extends through the bore 5 and the wheel member 6. The pin 7 is press fit in the body member 1. The wheel member 6 is thus adapted to rotate within a vertical plane and projects beyond the periphery of the body member, whereby it is functional to engage the inner surface of the tubing string (not shown) and centralize the coupling.

Since the wheel member 6 substantially corresponds in diameter with the inside diameter of the tubing string, the tubing wall will retain said wheel member in the slot, should the pin break. Thus, the danger of junk falling to the base of the well bore is reduced.

Figure 2:
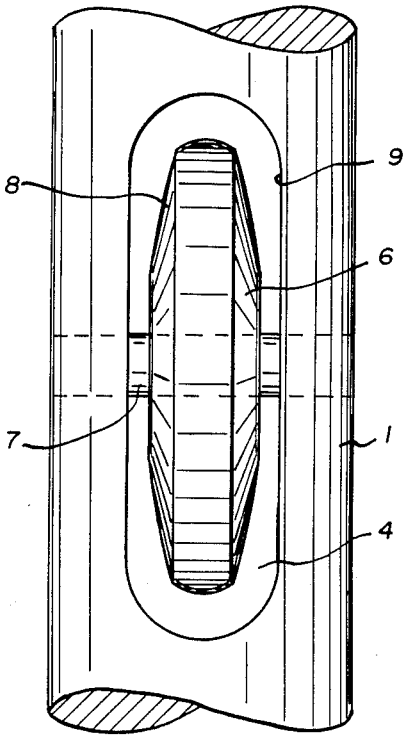
FIG. 2 is a side view showing a wheel positioned in a slot of the coupling.

As shown in FIG. 2, the thickness of the wheel member 6 is less than the width of the slot 4. Thus there is a clearance between each side surface 8 of the wheel member 6 and the adjacent wall surface 9 of the slot 4, when the wheel member is centered on the pin, as shown. Typically, for a wheel member having a diameter and maximum thickness of 2.36" and 0.45" respectively, I provide a slot having a length and width of 2.75" and 0.550" respectively. The slot remains constant in dimension, although the diameter of the wheel will vary with differing tubing sizes.

As previously stated, the provision of clearance as aforesaid permits the wheel member 6 to shuttle back and forth a short distance within the confines of the slot walls—this movement assists in clearing wax and sand out of the slot.

In a preferred design, I provide wheel members 6 having a lenticular configuration, as illustrated in FIG. 2. It is my belief that this design is particularly conducive to the ejection of wax and sand from the slot.

The wheel members 6 are formed of a hard, non-abrasive material, to minimize the possibility of scoring the tubing wall. I have found hard nylon to be suitable for most applications.

In summary, the wheel members function as an anti-frictional centralizing means, to minimize wear of the tubing by the rod string reciprocating therein. The provision of wheel members having approximately the same diameter as the tubing safeguards against the possibility of broken parts dropping down the hole. In combination, the slot, the lenticular configuration of the wheel member, and the lateral movement of the wheel member in the slot function to prevent wax and sand build up in the slot.

The embodiments of the invention in which an exclusive property or privilege is claimed are defined as follows:

1. An anti-friction sucker rod coupling for connecting a pair of sucker rods and centralizing then in a tubing string, comprising:

an elongate, rigid, substantially cylindrical body member, each end of said body member forming means for threadably connecting said body member with a sucker rod, said body member further forming a transversely extending, substantially diametric, generally vertical slot extending therethrough, said body member further forming a pin bore, such pin bore extending transversely through the body member so as to intersect the slot substantially perpendicularly;

a wheel member positioned within the slot to rotate in a generally vertical plane, said wheel member having a portion thereof extending beyond the periphery of said body member to engage the inner surface of the tubing string and centralize the coupling;

and a pin mounted in said pin bore and supporting member thereon, whereby the wheel member is rotatable within said slot;

said wheel member having sufficient clearance between its side surfaces and the wall surfaces of the slot, when the wheel member is centered in the slot on the pin, whereby the wheel member may. shift along the pin to assist in ejecting sand and oil from the slot.

2. An anti-friction sucker rod coupling as set forth in claim 1 wherein said wheel member has a substantially lenticular configuration, to thereby increase the open slot area in the proximity of the wheel periphery.

3. An anti-friction sucker rod coupling as set forth in claim 1 wherein the clearance is about 0.1 inches.

4. An anti-friction sucker rod coupling as set forth in claim 2 wherein the clearance is about 0.1 inches.

* * * * *